US005669980A

United States Patent [19]

McNeil et al.

[11] Patent Number: 5,669,980

[45] Date of Patent: Sep. 23, 1997

[54] ALUMINUM DESMUT COMPOSITION AND PROCESS

[75] Inventors: Maynard W. McNeil, Washington, N.J.; Edward J. Reimbold, Dunwoodle, Ga.; King C. Waldron, Lomita, Calif.

[73] Assignee: Atotech USA, Inc., Somerset, N.J.

[21] Appl. No.: 410,498

[22] Filed: Mar. 24, 1995

[51] Int. Cl.[6] ..... C11D 7/08; C11D 7/32; C23G 1/02

[52] U.S. Cl. ..... 134/3; 510/255; 510/257; 510/263; 510/269

[58] Field of Search ..... 252/142, 79.3, 252/86, 546, 147, 148, 544; 510/255, 257, 263, 269; 134/3

[56] References Cited

U.S. PATENT DOCUMENTS

| | | | |
|---|---|---|---|
| 3,448,055 | 6/1969 | Mickelson et al. | 252/79.3 |
| 3,879,216 | 4/1975 | Austin | 134/4 |
| 4,028,055 | 6/1977 | Doi et al. | 21/2.7 R |
| 4,073,618 | 2/1978 | Doi et al. | 21/2.7 R |
| 4,439,282 | 3/1984 | Byrd | 204/38 R |
| 4,541,945 | 9/1985 | Anderson et al. | 252/149 |
| 4,626,417 | 12/1986 | Young | 423/235 |
| 4,715,894 | 12/1987 | Holtzman et al. | 204/15 |
| 4,790,912 | 12/1988 | Holtzman et al. | 204/15 |
| 4,846,918 | 7/1989 | Nelson et al. | 156/628 |
| 4,959,105 | 9/1990 | Neidiffer et al. | 134/3 |
| 5,269,957 | 12/1993 | Ikeda et al. | 252/86 |
| 5,451,335 | 9/1995 | Hieatt et al. | 252/82 |

OTHER PUBLICATIONS

Harrison, "Plated Aluminum Wheel Characterization", Metal Finishing, Dec. 1994, pp. 11–16.

Kinki, "Aruminyumi Hyome Shori Kinky Ukai Kaishi", 146, 18–22 (1990) [Chemical Abstracts 114 (14) :127074e].

*Primary Examiner*—Paul Lieberman
*Assistant Examiner*—Gregory R. Delcotto
*Attorney, Agent, or Firm*—Finnegan, Henderson, Farabow, Garrett and Dunner, L.L.P.

[57] ABSTRACT

A composition of matter is disclosed for cleaning an aluminum surface comprising:

a hydroxy organic acid;

an organic complexing agent;

a phosphorous oxide acid;

a nitrogen oxide acid;

optionally a urea compound; and optionally a compound having a fluoride ion.

36 Claims, No Drawings

ALUMINUM DESMUT COMPOSITION AND PROCESS

BACKGROUND OF THE INVENTION

1. Field of the Invention

The field of the invention is compositions of matter for cleaning an aluminum surface and especially a surface of an aluminum-silicon alloy by the controlled removal of silicon, metals, and oxides thereof from the surface of said alloy.

2. Description of Related Art

Harrison et al. in an article "Plated Aluminum Wheel Characterization," *Metal Finishing,* Dec. 1994, pp. 11–16, notes that metal plating aluminum wheels is one of the growing areas of decorative automotive plating. Although plated aluminum wheels were a small after-market specialty item, this has become an original equipment manufacturer option and a special addition feature.

The major concerns in production of metal plated aluminum wheels have been the reliability of the plating process, appearance and cost.

In a typical sequence for applying metal coatings to aluminum, the substrate is polished and soak cleaned. The soak cleaner employed in the pretreatment of the aluminum surface removes finishing oils, grease and difficult-to-remove buffing compounds that may be left on the surface of the aluminum from polishing.

After the soak clean, the aluminum is immersed in a mild caustic or alkaline etch solution that is operated at elevated temperatures since it has been demonstrated that the etch rate is more dependent on temperature than caustic concentration. The importance of the mild alkaline etch is to remove the Beilby layer and to roughen the surface. When aluminum-silicon alloys are employed, the aluminum is etched preferentially over the silicon leaving coarse silicon crystals exposed on the surface.

An examination of the surface of the aluminum-silicon alloy shows that there are large areas of exposed silicon interspersed within the aluminum matrix. The silicon particles vary in size and do not appear to be uniformly distributed throughout the casting, and furthermore are not uniformly distributed on the surface of the aluminum, but rather in discrete areas. Silicon crystals protrude from the surface, most of which are oriented perpendicular to the surface.

After the etch treatment, the substrate is then subjected to a desmut composition. Smaller, loosely adherent silicon particles, as well as intermetallic compounds, are most likely removed during the desmut step. The substrate is then rinsed, zincated, stripped with nitric acid, zincated again, and followed by a nickel strike coating. This in turn is followed by a bright copper plating, optional copper buffing, nickel plating and an optional high sulfur nickel to improve corrosion resistance. After these preparatory steps, a decorative chromium plate is applied.

As noted by Harrison et al., a film is left on the aluminum after the mild caustic etch that is removed by the desmut step, and is one of the most crucial steps in processing the aluminum substrate to ensure adequate adhesion of the subsequently applied metal coatings. The tenacity of this film varies with the composition of the aluminum especially where an aluminum alloy is employed.

Aluminum wheels employed by the automotive industry are generally A356 aluminum alloy castings. The A356 alloy is generally chosen for aluminum wheel applications because of its ease of use in casting, high resistance to hot cracking, high fluidity, low shrinkage tendency and moderate ease of machinability.

The A356 alloy is a hypoeutectic alloy consisting mainly of a two-phase microstructure. Iron is present to minimize sticking between the molds and casting. Magnesium and copper are added to impart strength to the alloy. Manganese is believed to improve the high temperature properties of the casting. The silicon in the alloy appears as very hard particles and imparts wear resistance. Most of the hypoeutectic aluminum-silicon alloy consists of a soft and ductile aluminum phase.

The nominal composition of A356 aluminum alloys is as follows:

| Element | % by weight |
|---|---|
| Al | 91.9 |
| Si | 7.0 |
| Cu | 0.2 |
| Mg | 0.3 |
| Mn | 0.1 |
| Zn | 0.1 |
| Fe | 0.2 |
| Ti | 0.2 |

When treated in the foregoing manner, a heavy film tends to remain on the aluminum after the mild caustic etch. This film or smut is a mixture of both aluminum oxides and alloying element oxides as well as exposed silicon.

The desmut solution contains strong mineral acids, and when aluminum-silicon alloys are treated, fluoride ions. Both may be selected to uniformly attack the aluminum surface, or the proportions can be varied to preferentially dissolve the silicon (e.g., high fluoride concentration) and/or the aluminum. The aluminum and exposed silicon particles are thereby rendered more active. Various combinations of additives, nitric, sulfuric, and phosphoric acids in combination with fluoride salts such as ammonium bifluoride or fluoboric acid allow for adequate pretreatment of the aluminum to obtain good adhesion of subsequently applied metal coatings.

Lower molecular weight organic acids have also been employed in the cleaning or desmut process such as acetic acid but it has been found that use of these acids is unsuitable because of irritating odors they emit when the desmut solution is heated to improve the cleaning rate.

As noted, the desmut composition contains a mineral acid which in some applications will include a mixture of phosphoric acid and nitric acid. Problems, however, occur with this mixture in that nitrogen oxides are formed from nitric acid. This can be minimized or eliminated by including additives in the desmut solution.

Kinki, *Aruminyumu Hyome Shori Kinky Ukai Kaishi,* 146,18–22 (1990) [Chemical Abstracts 114 (14):127074e] describes a composition for polishing aluminum with a phosphoric acid-nitric acid mixture which contains acetamide, glycine, taurine, urea, biuret and ammonium carbamate with or without copper nitrite as nitrogen dioxide suppressants.

Martens et al., U.S. Pat. No. 4,846,918, describes a copper etching process and composition which promotes the formation of nitrous acid, and which consists of a nitric acid solution. A nitrous acid scavenger is optionally employed consisting of urea, hydrogen peroxide, hydrazine or sulfamic acid.

Young, U.S. Pat. No. 4,626,417, describes a method and composition to prevent or reduce the emission of nitrogen oxides from liquid systems and to convert nitrogen oxides contained in vapor streams to non-toxic materials, e.g., elemental nitrogen and water. The composition contains urea and sulfuric acid where the urea-sulfuric acid molar ratio is below 2.

Various cleaning compositions are also known in the art. Byrd, U.S. Pat. No. 4,439,282, describes a process for enhancing adhesive bonding of an aluminum substrate which comprises treating the substrate, after optional cleaning in an alkaline solution, with an ammoniacal solution of a copper salt to form a cuprammonium solution.

Holtzman et al., U.S. Pat. No. 4,790,912, describes a selective plating process for the electrolytic coating of circuit boards without an electrolytic metal coating. A cleaner conditioner component is described containing a chelating agent and an acid and optionally a fluoride salt, a thiourea compound, a surfactant and a poly(oxyalkylene) condensate of an alkyl phenol.

One of the advantages sought to be obtained by the present invention is to provide an equivalent to the lower molecular weight organic acids that have been employed in the cleaning or desmut process, i.e., a substitute for acetic acid and the like in order to avoid the irritating organic acid odors that are emitted when the desmut solution is heated.

It has been found that by using a hydroxy organic acid such as hydroxyacetic acid, objectionable odors are eliminated, however, the phosphoric acid-nitric acid mixture is inherently unstable initially, and a reaction occurs when all components are mixed together and heated, causing decomposition and evolution of nitrogen oxide fumes. Another advantage, therefore would be a composition that would avoid this problem as well.

Accordingly, the present invention is directed to a composition of matter and a process that substantially obviates one or more of these and other problems due to limitations and disadvantages of the related art.

SUMMARY OF THE INVENTION

These and other advantages are obtained according to the present invention.

Additional features and advantages of the invention will be set forth in the description which follows, and in part will be apparent from the description, or may be learned by practice of the invention. The objectives and other advantages of the invention will be realized and obtained by the composition of matter and process particularly pointed out in the written description and claims hereof.

To achieve these and other advantages, and in accordance with the purpose of the invention, as embodied and broadly described herein, the invention comprises employing a novel composition of matter for cleaning an aluminum surface comprising:

a hydroxy organic acid;

an organic complexing agent;

a phosphorous oxide acid;

a nitrogen oxide acid;

optionally a urea compound; and optionally a compound having a fluoride ion.

The hydroxy organic acid preferably is a monobasic monohydroxy organic acid, a dibasic monohydroxy organic acid or a monobasic dihydroxy organic acid such as a low molecular weight aliphatic organic acid, e.g., hydroxyacetic acid. The alpha-hydroxy organic acids are especially preferred.

The organic complexing agent employed in the composition preferably comprises an aminocarboxylic acid, especially a low molecular weight amino acid such as glycine.

The phosphorous oxide acid used in combination with a nitrogen oxide acid preferably comprises phosphoric acid. The nitrogen oxide acid preferably comprises nitric acid.

The composition optionally includes a urea compound which may comprise a urea, or a thiourea and the water soluble or water dispersible reaction products thereof but especially urea.

When the aluminum surface is based on an aluminum-silicon alloy, a compound having a fluoride ion is also incorporated in the formulation such as an alkali metal fluoride or hydrofluoric acid.

DETAILED DESCRIPTION OF THE INVENTION

The invention relates to a formulation for the treatment of aluminum surfaces, prior to metal coating, for the purpose of making the aluminum surface suitable for the adherence of the coatings. The treatment is sometimes referred to as a cleaning or desmut procedure.

The composition of matter for treating or cleaning an aluminum surface comprises:

a hydroxy organic acid;

an organic complexing agent;

a phosphorous oxide acid;

a nitrogen oxide acid;

an optional urea compound; and an optional compound having a fluoride ion.

The hydroxy organic acid comprises a monobasic, monohydroxy organic acid, a dibasic monohydroxy organic acid or a monobasic dihydroxy organic acid and especially those acids that are water soluble such as the alkyl or aromatic or lower alkyl substituted aromatic alpha-hydroxy organic acids, as well as their esters, salts, and anhydrides. Especially preferred acids are the lower alkyl alpha-hydroxy organic acids. Lower alkyl is intended to include those alkyl groups having from 1 to about 5 carbon atoms and the various isomeric configurations thereof such as isopropyl, isobutyl, t-butyl, and the like.

Various acids included within this group are the so-called "lactic acid series" such as hydroxyacetic acid (glycolic acid); hydroxy propionic acid, and especially 2-hydroxy propionic acid (lactic acid); hydroxybutyric acid; hydroxyvaleric acid, and hydroxycaproic acid. The lower molecular weight acids are especially preferred since they have a less pungent odor such as glycolic acid and lactic acid. Aromatic alpha hydroxy organic acids that may be employed comprise phenyl hydroxyacetic acid (mandelic acid) or 2,5-dimethyl phenyl hydroxyacetic acid. Of all the foregoing acids, the alpha-hydroxy substituted acids are especially preferred.

In initial experiments it was found that the use of hydroxy organic acids such as hydroxyacetic acid, although eliminating objectionable odors encountered when acetic acid was used, had inherent initial instability in the presence of the acid component of the cleaning solution, i.e., the mixture of the phosphorous oxide acids and the nitrogen oxide acids, phosphoric acid and nitric acid. Incorporation of the hydroxy organic acid such as hydroxyacetic acid caused the solution to decompose after being mixed together and heated with the other components, resulting in evolution of nitrogen oxide fumes.

It was discovered according to one aspect of the present invention that by incorporating an inorganic complexing agent into the formulation, it had the unexpected and beneficial effect of eliminating this chemical instability, yielding a formulation with no objectionable acetic acid odors but one that was inherently stable.

The organic complexing agent employed in this regard comprised glycine, although, any aminocarboxylic acid may be employed as well as other known complexing agents.

The complexing agent may comprise any of the various classes of complexing agents and specific compounds disclosed in Kirk-Othmer, *Encyclopedia of Chemical Technology*, Third Edition, Volume 5, pages 339–368, incorporated herein by reference. Complexing agents that are preferred comprise the aminocarboxylic acids and the hydroxycarboxylic acids. Some specific aminocarboxylic acids that may be employed in this respect comprise ethylenediaminetetraacetic acid, hydroxyethylethylenediaminetriacetic acid, nitrilotriacetic acid, N-dihydroxyethylglycine, and ethylenebis(hydroxyphenylglycine). Tetra (lower alkyl) ammonium hydroxy compounds may also be employed where the lower alkyl group has from about 2 to about 6 carbon atoms such as tetrabutyl ammonium hydroxide. The amino carboxylic acids used as complexing agents include lysine, alanine, valine, leucine, isoleucine, proline, phenylalanine, tryptophan, methionine, glycine, serine, threonine, cystenine, tyrosine, asparagine, glutamine, aspartic acid, glutamic acid, arginine, histidine and the like including the so-called rare amino acids, e.g., gamma-amino butyric acid, gamma-methyleneglutamic acid, 5-hydroxy lysine and the like. Carboxylic acids may also be employed and comprise tartaric acid, citric acid, gluconic acid and 5-sulfosalicylic acid. Mixtures of complexing agents may also be used, e.g., two or three or four component mixtures.

In a further embodiment of the invention, it has been found that by the addition of a urea compound to the composition, such as urea, the stability is increased further, especially when the solution is brought into contact with aluminum metal.

The various urea compounds that may be employed in this regard comprises either urea or the various substituted ureas or urea reaction products such as biuret; monoalkyl or dialkyl urea, where the alkyl group comprises a lower alkyl group having up to about five carbon atoms such as diethyl urea or monoethyl urea; saturated or unsaturated cyclic hydrocarbon mono- or disubstituted ureas where the cyclic hydrocarbon has up to ten carbon atoms, such as naphthyl urea, diphenyl urea, cyclohexyl urea and the like; alkoxy ethers of iso-urea especially lower alkoxy ethers of iso-urea where the lower alkyl group contains up to about five carbon atoms, these products being manufactured by the reaction of a lower alkanol with cyanamide hydrochloride; acid derivatives of urea in which the hydrogen atom of urea is substituted by an acyl group, these compounds sometimes being referred to as ureides obtained by the reaction of urea with a monocarboxylic aliphatic saturated or unsaturated organic acid having to about 20 carbon atoms and especially those acids having up to about four carbon atoms; the mineral acid salts of urea, e.g., urea mono- or disulfate, triuret; cyanuric acid (a trimer of urea); ammelide (a trimer of urea); imidol; carbamic acid esters of urea and $R^1OH$, (where $R^1$ is alkyl or alkenyl having up to about 6 carbon atoms, aryl, aralkyl, or alkaryl having up to about 12 carbon atoms, cycloalkyl, cycloalkylalkyl, or alkylcycloalkyl having up to about 12 carbon atoms) especially alkyl carbamates made by the reaction product of an organic alcohol with urea especially an alkanol such as a lower alkanol containing up to about four carbon atoms; monomethylol urea, dimethylol urea, trimethylol urea and other oligomers of urea and formaldehyde. The various substituted ureas are further disclosed by Ceresa, et al., in U.S. Pat. No. 2,891,871 which is incorporated herein by reference.

The urea compounds of the present invention also include thiourea compounds. The thiourea compounds comprise either thiourea or the various art known derivatives, homologs, or analogs thereof. Compounds that may be employed in this respect comprise 2,4-dithiobiuret; 2,4,6-trithiotriuret; alkoxy ethers of isothiourea; thiocyanuric acid (trimer of thiourea); thioammelide (trimer of thiourea); monalkyl or dialkyl thiourea, where the alkyl group comprises a lower alkyl group, having up to about four carbon atoms such as diethyl thiourea or monoethyl thiourea; saturated or unsaturated cyclic hydrocarbons mono- or disubstituted thioureas such as naphthyl thiourea, diphenyl thiourea, cyclohexyl thiourea and the like, where the cyclic hydrocarbons has up to about ten carbon atoms; the disulfide of thiourea; thio-imidol (the reaction product of thiourea and sodium hydroxide); thiocarbamic acid esters (the reaction products of thiourea and an alcohol comprising ROH where R is a saturated or unsaturated aliphatic or cyclic group having up to about ten carbon atoms) the oligomers of thiourea and formaldehyde, e.g., monomethylol, dimethylol, and trimethylol thioureas; S-alkyl pseudo thioureas (manufactured by the reaction of thiourea with an iodo lower alkane such as iodo methane where the lower alkyl group contains up to about five carbon atoms); thiocarbonic acid esters of thiourea and $R^1OH$, ($R^1$ as defined above) especially where $R^1$ is lower alkyl; thioureadioxide (aka formamidinesulfinic acid [1758-73-2, C.A. Reg. No.]); the reaction product of a saturated or unsaturated aliphatic or cyclic organic acid having up to about 12 carbon atoms and especially the lower aliphatic monocarboxylic acid reaction products with thiourea, e.g., acylthioureas, and the mineral acid salts of thiourea, e.g., thiourea mono- or di-sulfate.

Various mixtures of the urea compounds may also be employed, especially the two or three component mixtures.

Other specific ureas and thioureas that may be employed as the urea compound are further disclosed in Holtzman et al., U.S. Pat. Nos. 4,715,894 and 4,790,912, both of which are incorporated herein by reference.

In addition, hydrazine and the various art known equivalents, melamine, sulfamic acid, taurine, biuret and ammonium carbamate may also be employed.

The composition of the invention also includes a mixture of phosphorous oxide acids and nitrogen oxide acids. The phosphorous oxide acids that are employed in this respect include hypophosphoric acid, metaphosphoric acid, orthophosphoric acid or pyrophosphoric acid. In addition, organophosphoric acids may be employed such as the phosphinic acids, phospho acids or the phosphonic acids where the organo portions of the acids are either aliphatic or aromatic substituents, especially where the aliphatic substituents comprise the lower alkyl substituents, i.e, those having 1 to about 5 carbon atoms and the various isomeric configurations thereof as stated herein. The aromatic substituents comprise, those having from 6 to about 10 carbon atoms including the lower aliphatic substituted aromatic compounds as lower aliphatic is defined herein.

Mixtures of the various phosphorous oxide acids may be employed, especially the 2 to 3 component mixtures.

The inorganic phosphorous oxide acids are preferred, especially phosphoric acid.

The nitrogen oxide acids that may be employed include either nitric or nitrous acids, especially nitric acid.

Where the compound is employed for cleaning the surface of an aluminum-silicon alloy by the controlled removal of silicon, metals and oxides thereof from the surface, a compound having a fluoride ion is also included in the composition. The source of the fluoride ion may be any fluoride salt such as ammonium bifluoride, aluminum trifluoride, sodium fluoride, sodium bifluoride, potassium bifluoride, ammonium fluoride, fluoroboric acid or hydrofluoric acid. Ammonium bifluoride or ammonium fluoride would not ordinarily be employed where ammonia fumes would be a potential irritant. The alkali metal fluorides and hydrofluoric acid are especially suitable in this regard. Mixtures of the various compounds that will provide a fluoride ion may also be employed, especially the 2 component or 3 component mixtures.

The ratio of the various components of the formulation can be determined readily by a person with ordinary skill in the art by employing simple experimentation. In one embodiment, the composition of matter for cleaning an aluminum surface comprises the following:

| | |
|---|---|
| a hydroxy organic acid | about 70 to about 140 g/l |
| an organic complexing agent | about 20 to 35 g/l |
| a phosphorous oxide acid | about 50 to 60% by volume an acid having about an 85 concentration |
| a nitrogen oxide acid | about 5 to about 15% by vo of an acid having about 60 about 63% concentration. |
| a urea compound | about 0 to 20 g/l |
| a compound having a fluoride ion | 0 to about 4 g/l |

In another embodiment of the invention, the composition comprises:

| Formulation 1 | |
|---|---|
| hydroxyacetic acid | about 70 to about 140 g/l |
| glycine | about 20 to about 35 g/l |
| urea | about 0 to about 20 g/l |
| alkaline metal fluoride | about 0 to about 4 g/l |
| phosphoric acid | about 50 to about 60% by volume of an acid having a an 85% concentration |
| nitric acid | about 5 to about 15% volum an acid having about 60 to about 63% concentration. |

An A356 cast aluminum alloy wheel is polished and soak cleaned, followed by immersion in a mild alkaline etch solution at about 150° F. After etching and rinsing, the casting is then immersed in a desmut composition of Formulation 1 at about 100° F. for about 2 minutes, removed from the desmut solution and rinsed again. The casting is then zincated, stripped with nitric acid, zincated again and then coated with a nickel strike coating, followed by plating with bright copper, buffing, nickel plating and then plating with a high sulfur nickel coating to improve corrosion resistance. A decorative chromium metal coating is then applied to the casting prepared in the foregoing manner.

The desmut composition of the present invention can be employed at temperatures of from about 60 to about 120° F., preferably from about 90 to about 110° F. and especially from about 95° F. to about 105° F., for a period of time from about ½ to about 10, preferably from about 2 to about 5 and especially from about 2 to about 3 (minutes) in the foregoing process in order to effectively remove smut from an aluminum surface.

It will be apparent to those skilled in the art that modifications and variations can be made in the novel composition of matter and process for cleaning an aluminum surface of the present invention without departing from the spirit or scope of the invention. It is intended that these modifications and variations and their equivalents are to be included as part of this invention, provided they come within the scope of the appended claims.

What is claimed:

1. A composition of matter for cleaning an aluminum surface comprising:

from about 70 to about 140 g/l of a hydroxy organic acid;

from about 20 to about 35 g/l of an aminocarboxylic acid complexing agent;

an aqueous phosphorous oxide acid at about 85% concentration in an amount from about 50 to about 60% by volume;

an aqueous nitrogen oxide acid at about 60 to about 65% concentration in an amount from about 5 to about 15% by volume;

from 0 to about 20 g/l of a urea compound; and from 0 to about 4 g/l of a compound having a fluoride ion.

2. The composition of matter of claim 1, wherein said hydroxy organic acid comprises a monobasic monohydroxy organic acid; a dibasic monohydroxy organic acid; or a monobasic dihydroxy organic acid.

3. The composition of claim 2, wherein;

said hydroxy organic acid comprises a lower molecular weight aliphatic alpha-hydroxy organic acid; and said organic complexing agent comprises a lower molecular weight aminocarboxylic acid.

4. The composition of claim 3 wherein;

said hydroxy organic acid is hydroxyacetic acid or 2-hydroxpropionic acid;

said organic complexing agent comprises glycine;

said phosphorous oxide acid comprises phosphoric acid;

said nitrogen oxide acid comprises nitric acid;

said urea compound comprises a urea; and said compound having a fluoride ion is an alkali metal fluoride or hydrofluoric acid.

5. A process for cleaning an aluminum surface comprising applying to said surface a composition of matter comprising:

from about 70 to about 140 g/l of a hydroxy organic acid;

from about 20 to about 35 g/l of an aminocarboxylic acid complexing agent;

an aqueous phosphorous oxide acid at about 85% concentration in an amount from about 50 to about 60% by volume;

an aqueous nitrogen oxide acid at about 60 to about 65% concentration in an amount from about 5 to about 15% by volume;

from 0 to about 20 g/l of a urea compound; and from 0 to about 4 g/l of a compound having a fluoride ion.

6. The process of claim 5, wherein said hydroxy organic acid comprises a monobasic monohydroxy organic acid; a dibasic monohydroxy organic acid; or a monobasic dihydroxy organic acid.

7. The process of claim 6, wherein;

said hydroxy organic acid comprises a lower molecular weight aliphatic alpha-hydroxy organic acid;

said organic complexing agent comprises a lower molecular weight aminocarboxylic acid.

8. The process of claim 7 wherein;

said hydroxy organic acid is hydroxyacetic acid or 2-hydroxypropionic acid;

said organic complexing agent comprises glycine;

said phosphorous oxide acid comprises phosphoric acid;

said nitrogen oxide acid comprises nitric acid;

said urea compound comprises urea; and said compound having a fluoride ion is an alkali; metal fluoride or hydrofluoric acid.

9. The composition of claim 1 including a urea compound wherein said urea compound comprises a urea or a thiourea and the water soluble or water dispersible reaction products thereof.

10. The composition of claim 9 wherein said urea compound comprises a urea.

11. The process of claim 5 including a urea compound wherein said urea compound comprises a urea or a thiourea and the water soluble or water dispersible reaction products thereof.

12. The process of claim 11 wherein said urea compound comprises a urea.

13. A product for cleaning an aluminum surface produced by the process comprising mixing:

from about 70 to about 140 g/l of a hydroxy organic acid;

from about 20 to about 35 g/l of an aminocarboxylic acid complexing agent;

an aqueous phosphorous oxide acid at about 85% concentration in an amount from about 50 to about 60% by volume;

an aqueous nitrogen oxide acid at about 60 to about 65% concentration in an amount from about 5 to about 15% by volume;

from 0 to about 20 g/l of a urea compound; and from 0 to about 4 g/l of a compound having a fluoride ion.

14. The product produced by the process of claim 13, wherein said hydroxy organic acid comprises a monobasic monohydroxy organic acid; a dibasic monohydroxy organic acid; or a monobasic dihydroxy organic acid.

15. The product produced by the process of claim 14, wherein;

said hydroxy organic acid comprises a lower molecular weight aliphatic alpha-hydroxy organic acid; and said organic complexing agent comprises a lower molecular weight aminocarboxylic acid.

16. The product produced by the process of claim 15 wherein;

said hydroxy organic acid is hydroxyacetic acid or 2-hydroxypropionic acid;

said organic complexing agent comprises glycine;

said phosphorous oxide acid comprises phosphoric acid;

said nitrogen oxide acid comprises nitric acid;

said urea compound comprises a urea; and said compound having a fluoride ion is an alkali metal fluoride or hydrofluoric acid.

17. The product produced by the process of claim 13 including a urea compound wherein said urea compound comprises a urea or a thiourea and the water soluble or water dispersible reaction products thereof.

18. The product produced by the process of claim 17 wherein said urea compound comprises a urea.

19. A desmut composition of matter for an aluminum-silicon alloy wherein said composition is a mixture of compounds comprising:

from about 70 to about 140 g/l of a hydroxy organic acid;

from about 20 to about 35 g/l of an aminocarboxylic acid complexing agent;

an aqueous phosphorous oxide acid at about 85% concentration in an amount from about 50 to about 60% by volume;

an aqueous nitrogen oxide acid at about 60 to about 65% concentration in an amount from about 5 to about 15% by volume;

from 0 to about 20 g/l of a urea compound; and from 0 to about 4 g/l of a compound having a fluoride ion; where said compounds are present in an amount sufficient to remove smut from the surface of said aluminum-silicon alloy.

20. The composition of matter of claim 19, wherein said hydroxy organic acid comprises a monobasic monohydroxy organic acid; a dibasic monohydroxy organic acid; or a monobasic dihydroxy organic acid.

21. The composition of claim 20, wherein;

said hydroxy organic acid comprises a lower molecular weight aliphatic alpha-hydroxy organic acid; and said organic complexing agent comprises a lower molecular weight aminocarboxylic acid.

22. The composition of claim 21 wherein;

said hydroxy organic acid is hydroxyacetic acid or 2-hydroxypropionic acid;

said organic complexing agent comprises glycine;

said phosphorous oxide acid comprises phosphoric acid;

said nitrogen oxide acid comprises nitric acid;

said urea compound comprises a urea; and said compound having a fluoride ion is an alkali metal fluoride or hydrofluoric acid.

23. A process for removing smut from an aluminum-silicon alloy surface comprising applying to said surface a composition of matter wherein said composition is a mixture of compounds comprising:

from about 70 to about 140 g/l of a hydroxy organic acid;

from about 20 to about 35 g/l of an aminocarboxylic acid complexing agent;

an aqueous phosphorous oxide acid at about 85% concentration in an amount from about 50 to about 60% by volume;

an aqueous nitrogen oxide acid at about 60 to about 65% concentration in an amount from about 5 to about 15% by volume;

from 0 to about 20 g/l of a urea compound; and from 0 to about 4 g/l of a compound having a fluoride ion; where said compounds are present in an amount sufficient to remove smut from the surface of said aluminum-silicon alloy.

24. The process of claim 23, wherein said hydroxy organic acid comprises a monobasic monohydroxy organic acid; a dibasic monohydroxy organic acid; or a monobasic dihydroxy organic acid.

25. The process of claim 24, wherein;

said hydroxy organic acid comprises a lower molecular weight aliphatic alpha-hydroxy organic acid;

said organic complexing agent comprises a lower molecular weight amino carboxylic acid.

26. The process of claim 22 wherein;

said hydroxy organic acid is hydroxyacetic acid or 2-hydroxypropionic acid;

said organic complexing agent comprises glycine;

said phosphorous oxide acid comprises phosphoric acid;

said nitrogen oxide acid comprises nitric acid;

said urea compound comprises urea; and said compound having a fluoride ion is an alkali metal fluoride or hydrofluoric acid.

27. The composition of claim 19 including a urea compound wherein said urea compound comprises a urea or a thiourea and the water soluble or water dispersible reaction products thereof.

28. The composition of claim 27 wherein said urea compound comprises a urea.

29. The process of claim 23 including a urea compound wherein said urea compound comprises a urea or a thiourea and the water soluble or water dispersible reaction products thereof.

30. The process of claim 29 wherein said urea compound comprises a urea.

31. A product for removing smut from an aluminum-silicon alloy surface produced by the process comprising mixing the compounds:

from about 70 to about 140 g/l of a hydroxy organic acid;

from about 20 to about 35 g/l of an aminocarboxylic acid complexing agent;

an aqueous phosphorous oxide acid at about 85% concentration in an amount from about 50 to about 60% by volume;

an aqueous nitrogen oxide acid at about 60 to about 65% concentration in an amount from about 5 to about 15% by volume;

from 0 to about 20 g/l of a urea compound; and from 0 to about 4 g/l of a compound having a fluoride ion; where said compounds are present in an amount sufficient to remove smut from the surface of said aluminum-silicon alloy.

32. The product produced by the process of claim 31, wherein said hydroxy organic acid comprises a monobasic monohydroxy organic acid; a dibasic monohydroxy organic acid; or a monobasic dihydroxy organic acid.

33. The product produced by the process of claim 32, wherein;

said hydroxy organic acid comprises a lower molecular weight aliphatic alpha-hydroxy organic acid; and said organic complexing agent comprises a lower molecular weight aminocarboxylic acid.

34. The product produced by the process of claim 33 wherein;

said hydroxy organic acid is hydroxyacetic acid or 2-hydroxypropionic acid;

said organic complexing agent comprises glycine;

said phosphorous oxide acid comprises phosphoric acid;

said nitrogen oxide acid comprises nitric acid;

said urea a compound comprises a urea; and said compound having a fluoride ion is an alkali metal fluoride or hydrofluoric acid.

35. The product produced by the process of claim 31 including a urea compound wherein said urea compound comprises a urea or a thiourea and the water Soluble or water dispersible reaction products thereof.

36. The product produced by the process of claim 35 wherein said urea compound comprises a urea.

* * * * *